US007757304B1

(12) United States Patent
Real et al.

(10) Patent No.: US 7,757,304 B1
(45) Date of Patent: Jul. 20, 2010

(54) SAFETY APPARATUS FOR A PERSON AT AN ELEVATED LOCATION

(76) Inventors: Vincent L. Real, 9310 E. Main St., Space 158, Mesa, AZ (US) 85207; Vickie Real, 9310 E. Main St., Space 158, Mesa, AZ (US) 85207; Vernon Edwin Heide, North 508 Bowdish, Spokane, WA (US) 99206; Douglas G. Dixon, 515 E. McAdams Rd., Longview, WA (US) 98632

( * ) Notice: Subject to any disclaimer, the term of this patent is extended or adjusted under 35 U.S.C. 154(b) by 32 days.

(21) Appl. No.: 11/739,922

(22) Filed: Apr. 25, 2007

(51) Int. Cl.
*A41D 13/00* (2006.01)

(52) U.S. Cl. ..... 2/69

(58) Field of Classification Search ..... 2/69, 2/94, 79, 102, 44–45, 81, 327, 108, 93, 456; 182/3–6; 244/151 R
See application file for complete search history.

(56) References Cited

U.S. PATENT DOCUMENTS

| | | | | |
|---|---|---|---|---|
| 1,849,628 | A | 3/1932 | Lemercier | |
| 2,979,153 | A | 4/1961 | Hoagland et al. | |
| 4,177,877 | A | 12/1979 | Gallinati | |
| 4,731,882 | A | 3/1988 | Ekman | |
| 6,101,631 | A | 8/2000 | Ferguson, Jr. | |
| RE37,394 | E | 10/2001 | Woodyard | |
| 6,305,024 | B1 | 10/2001 | Schweer | |
| 6,637,547 | B1 | 10/2003 | Wydner | |
| 6,658,666 | B2 | 12/2003 | Schweer | |
| 6,698,026 | B2 | 3/2004 | Schweer | |
| 6,892,395 | B2 | 5/2005 | Schweer | |
| 7,047,567 | B2 * | 5/2006 | Allen | 2/69 |
| 7,467,419 | B2 * | 12/2008 | O'Neal et al. | 2/69 |
| 7,571,494 | B2 * | 8/2009 | Grilliot et al. | 2/69 |

* cited by examiner

*Primary Examiner*—Tejash Patel
(74) *Attorney, Agent, or Firm*—Schmeiser Olsen & Watts LLP

(57) ABSTRACT

A safety apparatus for a person includes a harness and jacket worn by the person. The harness includes a dorsal ring and the jacket includes a dorsal opening aligned with the dorsal ring. A safety line can be attached to the dorsal ring without interfering with the operation of the jacket. The jacket is repeatably moveable between positions covering and uncovering the harness so that the jacket can be replaced with another one without removing the harness.

19 Claims, 10 Drawing Sheets

SAFETY APPARATUS FOR A PERSON AT AN ELEVATED LOCATION

BACKGROUND OF THE INVENTION

1. Field of the Invention

This invention relates generally to safety equipment for people working at elevated locations.

2. Description of the Related Art

People at elevated locations generally use safety equipment in case they fall. For example, some people wear a harness attached to an anchor point with a safety line. In this way, if the person falls, the fall will be secure because the harness and safety line will stop them. Some of these harnesses are built into a jacket to provide protection from the weather. These harnesses and jackets are typically made for recreational use, such as hunting from a tree stand. Examples of harnesses and jackets for recreational use are disclosed in U.S. Pat. Nos. 6,305,024, 6,637,547, 6,658,666, 6,698,026 and 6,892,395.

Recreational use jackets and harnesses, however, are generally unsuitable for industrial use under more extreme conditions where it is sometimes necessary to stop the fall of a heavier load. For example, workers often carry heavy materials and/or equipment when working, and the worker and the equipment he or she carries present a heavy load. Further, some workers, such as linemen, often work at elevated locations that are greater than 50 feet above the ground. Examples of these elevated locations include towers for power lines and cell phones, which sometimes extend 200 feet to 400 feet or more above the ground. These locations are elevated enough to cause serious bodily injury and death if the lineman experiences an unsecured fall.

One problem often faced by workers at these elevated locations is being exposed to the weather. The weather sometimes necessitates, for example, that the worker wear a jacket over his or her harness. However, a safety line attached to the harness can interfere with the wearing of the jacket. Further, it is sometimes desirable to change jackets in response to changing weather conditions. However, if the worker is using a harness built into a jacket, the worker is required to remove and change both. While removing and changing the harness and jacket, the worker is undesirably exposed to experiencing an unsecured fall. Further, it is often against safety regulations for the worker to detach the safety line from the harness while at the elevated location.

One type of jacket made for linemen is sold as NASCO ARCLITE 1100 SERIES RAINGEAR™. This jacket provides safety line access through its backside. However, this type of jacket is a rain jacket, so it may not be suitable for other weather conditions often faced by workers.

BRIEF SUMMARY OF THE INVENTION

The present invention employs a safety apparatus for a person, wherein the safety apparatus includes a harness and jacket worn by the person. The jacket and harness are repeatably separable from each other so they can be worn separately and together. This is useful so the jacket can be removed and replaced with another one without removing the harness. The safety apparatus is made to meet or exceed standards set forth by the Occupational Safety and Health Administration (OSHA), such as OSHA 1910.269. These standards are known to apply to workers, such as linemen, who work at elevated locations.

The harness includes a dorsal ring and the jacket includes a dorsal opening extending therethrough. The dorsal opening is aligned with the harness so the dorsal ring extends through it when the person is wearing the harness and jacket. Because the dorsal ring extends through the dorsal opening, it can be attached to a safety line without interfering with the wearing of the jacket.

In accordance with the invention, a flap is attached to the jacket and is repeatably moveable between positions covering and uncovering the dorsal opening. When the flap covers the dorsal opening, the dorsal ring can extend through it and be attached to the safety line. In this way, the flap covers the opening and reduces the likelihood of weather conditions from undesirably entering the opening.

These and other features, aspects, and advantages of the present invention will become better understood with reference to the following drawings and description.

DETAILED DESCRIPTION OF THE INVENTION

Figure 1:
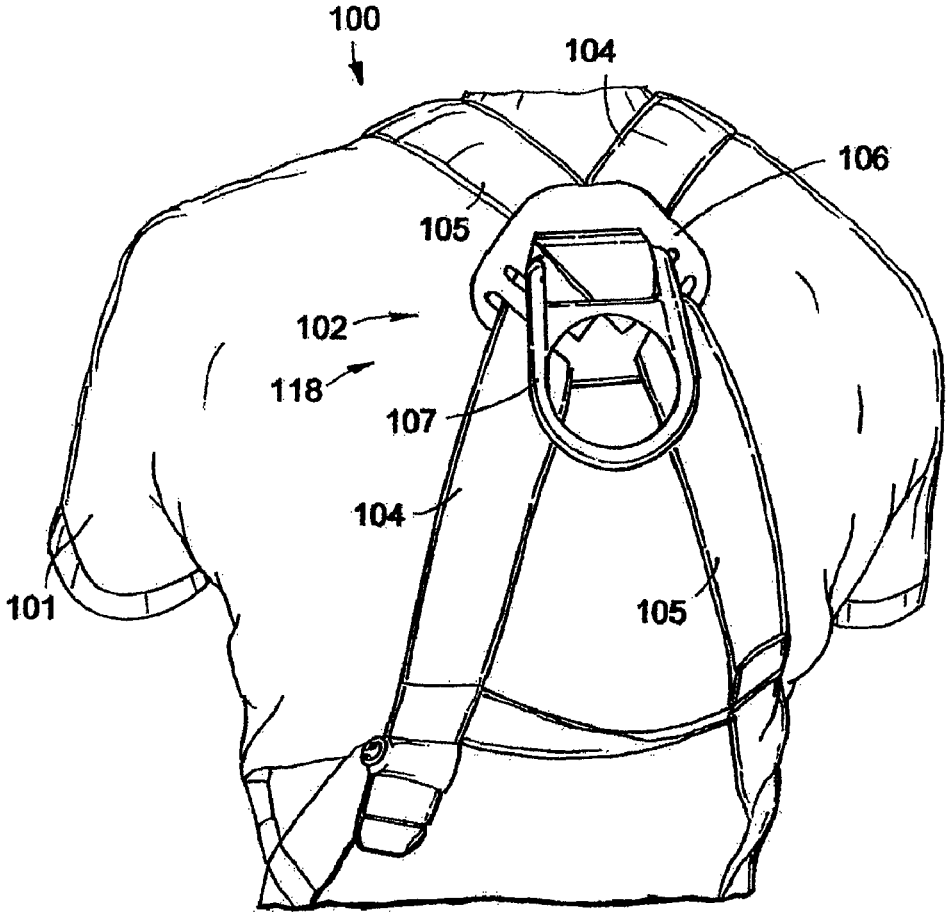
FIG. 1 is a back view of a person wearing a garment and harness with a dorsal ring.

FIG. 1 is a back view of a person 100 wearing a garment 101 and a harness 102. Garment 101 can be of many different types, such as a shirt, jacket, sweater, and other apparel. Harness 102 is worn over garment 101 so it is more comfortable to wear. Harness 102 can be of many different types, but it is generally one used by a lineman. These types of harnesses are often made from nylon and are rated to break the fall of a person falling a greater height than harnesses used for recreational purposes. These types of harnesses are also rated to break the fall of a heavier load than harnesses used for recreational purposes.

In this embodiment, harness 102 includes torso straps 104 and 105 which extend around the torso of person 100 and cross each other at a dorsal location 118 of person 100. Dorsal location 118 is generally proximate to the shoulders and back of person 100. Harness 102 includes a strap guide 106 which guides torso straps 104 and 105 when they cross each other at dorsal location 118. In this way, straps 104 and 105 are less likely to become uncrossed and are more likely to remain proximate to dorsal location 118.

In this embodiment, harness 102 includes a dorsal ring 107 coupled to straps 104 and 105, as well as strap guide 106. Dorsal ring 107 can be of many different types, but here it is a D-ring. Dorsal ring 107 can be coupled to strap guide 106 and straps 104 and 105 at many different locations, but here it is coupled thereto proximate to dorsal location 118. Dorsal ring 107 is coupled to harness 102 by extending torso straps 104 and 105 through a first opening of dorsal ring 107. Straps 104 and 105 also extend through strap guide 106 so that dorsal ring 107 is held between strap guide 106 and torso straps 104 and 105. In this way, dorsal ring 107 is held in place at dorsal location 118. It should be noted that dorsal ring 107 also includes a second opening for receiving a lanyard, as will be discussed in more detail presently.

Figure 2:
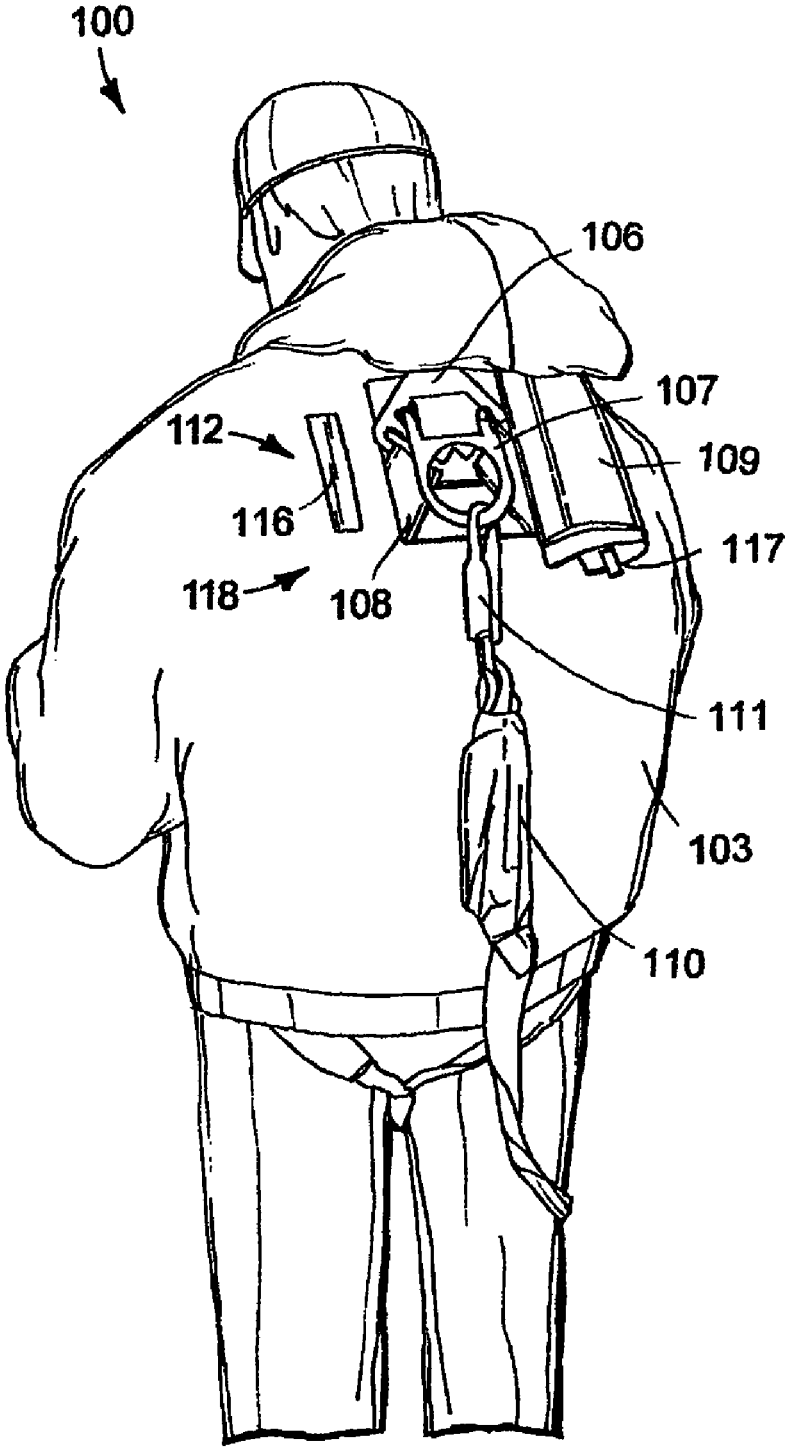
FIG. 2 is a back view of the person of FIG. 1 wearing a jacket over the garment and harness, wherein the jacket includes, in accordance with the invention, a dorsal opening coverable with a flap.

FIG. 2 is a back view of person 100 wearing a jacket 103 over garment 101 and harness 102, in accordance with the invention. Jacket 103 can be of many different types and is generally selected in response to the weather conditions that person 100 is exposed to. Hence, jacket 103 can be a heavy jacket for cold weather, a light jacket for cool weather, a rain jacket for rainy weather, and a wind breaker for windy weather.

It is well-known that a jacket repels weather conditions, such as wind, rain and cold. In this way, the jacket protects the person wearing it from different types of weather conditions. A jacket also works by retaining heat between it and the person wearing it. The heat is generally retained between the interior of jacket 103 and the person wearing it, wherein the interior of jacket 103 faces person 100 when it is being worn. The exterior of jacket 103 faces away from person 100 and is exposed to the weather conditions. It should be noted that some jackets are reversible in that they can be worn inside-out and outside-in.

It should also be noted that a jacket generally includes one or more layers so it can be made to retain a desired amount of heat. For example, most cold weather jackets include inner and outer layers with insulation positioned between them. In general, a jacket retains more heat as the amount of insulation and the number of layers included therewith increases. Further, a jacket retains less heat as the amount of insulation and the number of layers included therewith decreases.

In accordance with the invention, jacket 103, garment 101 and harness 102 are repeatably separable from each other. For example, jacket 103 is repeatably moveable between positions covering and uncovering harness 102, as well as garment 101. In this way, garment 101, harness 102 and jacket 103 are separately wearable. The ability to separate jacket 103 and harness 102 from each other is useful in situations in which it is desirable to remove jacket 103, such as in response to changing weather conditions. It is generally desirable to be able to separate jacket 103 and harness 102 without removing harness 102 from person 100.

For example, if person 100 is too hot, then he or she can remove jacket 103 and replace it with one that has fewer layers and less insulation so it retains less heat. In response to wearing a jacket that retains less heat, person 100 will be cooler. If person 100 is too cold, then he or she can remove jacket 103 and replace it with one that has more layers and more insulation so it retains more heat. In response to wearing a jacket that retains more heat, person 100 will be warmer. If it starts to rain, person 100 can remove jacket 103 and replace it with a rain jacket, which repels rain. Further, if the wind speed increases, person 100 can remove jacket 103 and replace it with a windbreaker, which repels wind.

In any of these situations, it is generally undesirable to remove harness 102 while replacing jacket 103, especially if person 100 is at an elevated location. It is undesirable to remove harness 102 because this increases the likelihood of person 100 experiencing an unsecured fall from the elevated location. It is also undesirable to remove harness 102 because it is inconvenient. It is inconvenient because removing harness 102 and jacket 103 takes more time than replacing jacket 103, so that person 100 is exposed to the weather, as well as to taking an unsecured fall, for a longer period of time.

In this embodiment, jacket 103 includes a dorsal opening 108 extending through its back portion 112, and a flap 109 attached to jacket 103. Dorsal opening 108 and flap 109 are shown in more detail in FIG. 3*a*, which is a close-up view of back portion 112. Flap 109 can be made of many different materials, but it generally includes the same material as the exterior of jacket 103. However, it is useful if flap 109 includes a material that repels the cold, wind and/or rain so that these weather conditions are less likely to enter dorsal opening 108 when flap 109 covers it, as will be discussed in more detail below.

Dorsal opening 108 is positioned so that it is aligned with dorsal ring 107 and strap guide 106 when jacket 103 and harness 102 are worn by person 100. Dorsal opening 108 and dorsal ring 107 are aligned so that dorsal ring 107 is repeatably moveable through dorsal opening 108 between positions enclosed and unenclosed by jacket 103. In this way, opening 108 is positioned at dorsal location 118 so that dorsal ring 107 can extend through it. It should be noted that a position enclosed by jacket 103 is located between person 100 and jacket 103. Further, a position unenclosed by jacket 103 is located at its exterior.

Opening 108 extends between positions enclosed and unenclosed by jacket 103. In this way, opening 108 extends through jacket 103 between its interior and exterior, so that access is provided through it to dorsal ring 107. For example, as mentioned above, when jacket 103 is a cold weather jacket, opening 108 extends through the inner and outer layers, as well as the insulation positioned between them. The outer periphery of opening 108 is generally closed to keep the insulation within jacket 103. The outer periphery of opening 108 can be closed in many different ways, such as with stitching. It should be noted that dorsal opening 108 can have many different shapes, a few of which are discussed with FIGS. 3*b*, 7*a* and 7*b*, and 8*a*, 8*b* and 8*c*.

In this embodiment, a safety line 110 is attached to dorsal ring 107 and another end of safety line 110 is attached to an anchor point (not shown). Safety line 110 can be of many different types, such as a nylon strap and rope. Further, safety line 110 can be made of many different materials, such as nylon. Safety line 110 can be attached to dorsal ring 107 in many different ways, but here it is attached thereto with a lanyard 111.

Figure 3A:
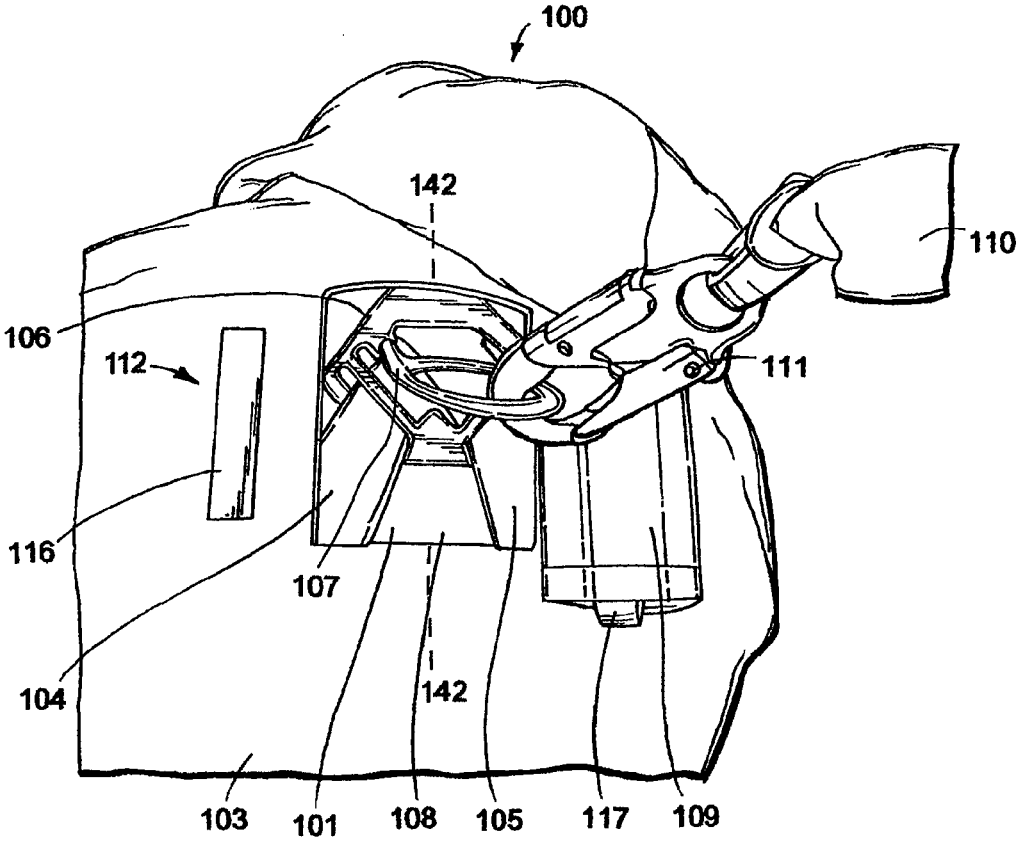
FIG. 3*a* is a close-up view of the back portion of the jacket of FIG. 2, showing the dorsal opening.

It should be noted that lanyard 111 is generally positioned outside of jacket 103. For example, when dorsal ring 107 extends outwardly from dorsal opening 108, safety line 110 can be attached thereto with lanyard 111, as shown in FIGS. 2 and 3*a*. When dorsal ring 107 does not extend through opening 108, lanyard 111 and safety line 110 can extend between jacket 103 and garment 101 so that lanyard 111 is attached to dorsal ring 107 at a position enclosed by jacket 103, as shown in FIG. 4*c*.

Figure 4A:
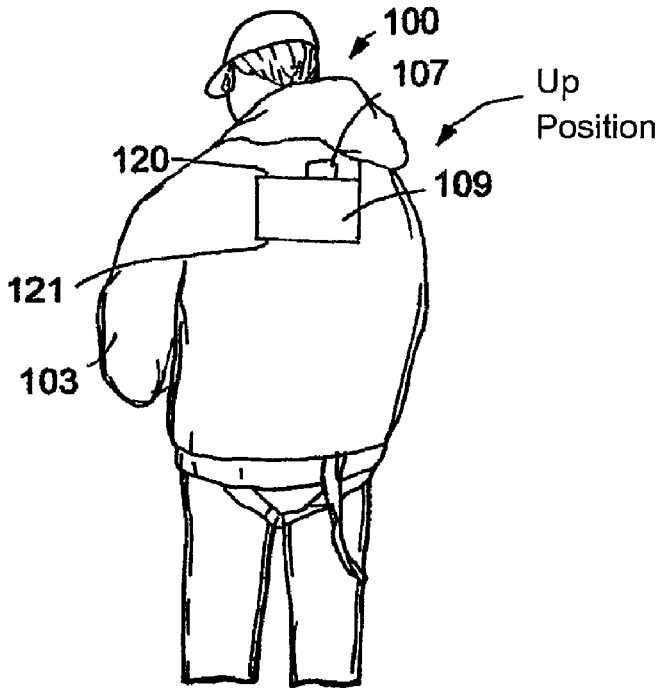
FIGS. 4*a* and 4*b* are views of the flap covering the opening, wherein the dorsal ring extends upwardly and downwardly, respectively, from the dorsal opening.
Figure 4B:
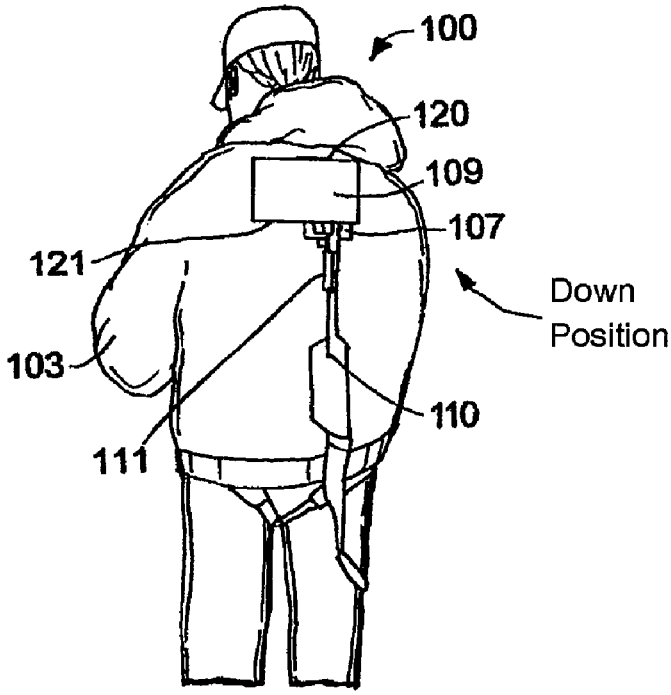
Figure 4C:
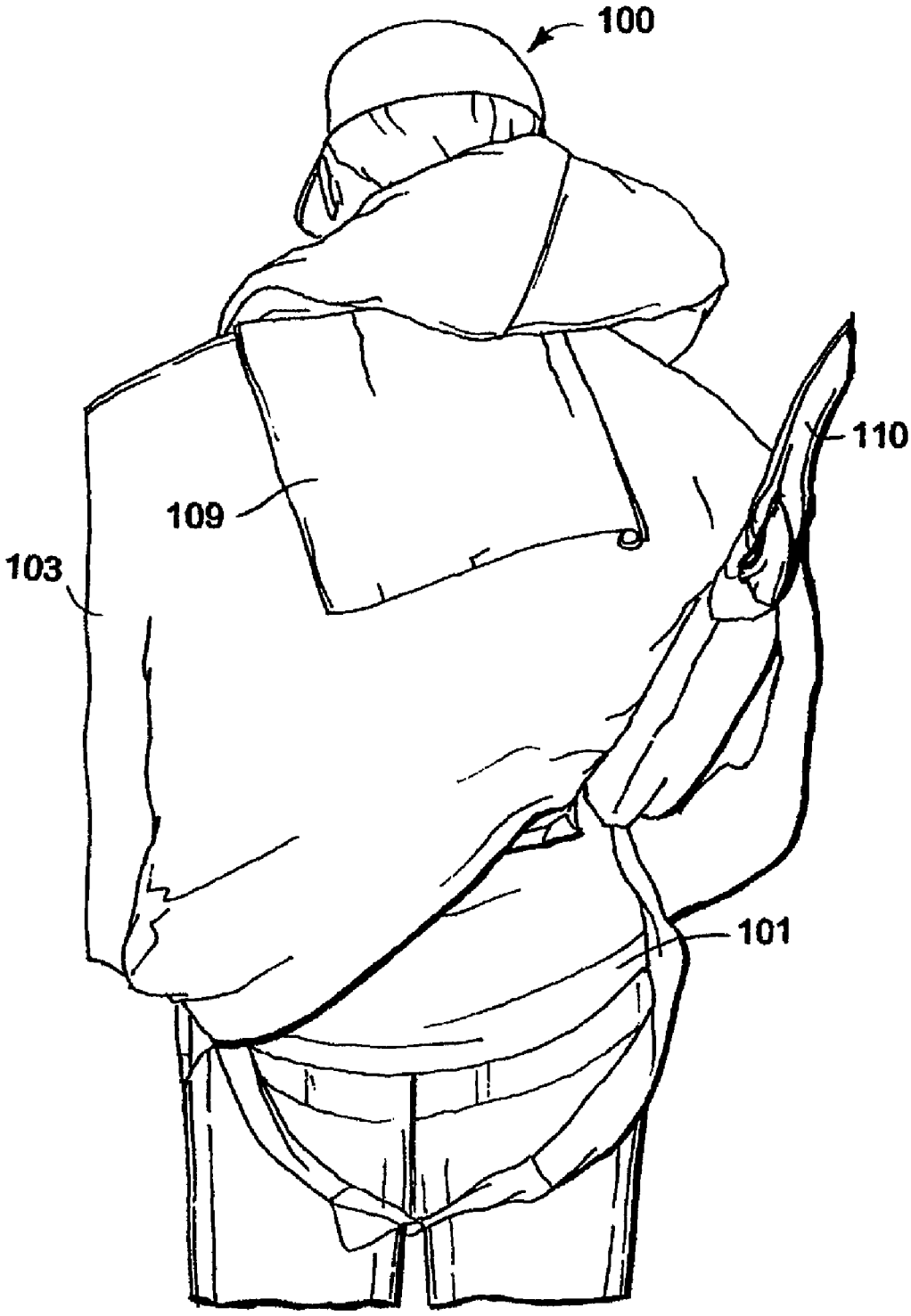
FIG. 4*c* is a back view of a safety line connected to the dorsal ring, wherein the safety line extends between the garment and jacket.

It should also be noted that lanyard 111 and safety line 110 are repeatably moveable between being connected to dorsal ring 107 as shown in FIGS. 2 and 3*a*, and as shown in FIG. 4*c*. This is useful because, when safety line 110 is connected to dorsal ring 107 as shown in FIG. 4*c*, jacket 103 can be removed while person 100 is protected from experiencing an unsecured fall. After jacket 103 has been replaced with another one, lanyard 111 can be disconnected from dorsal ring 107 and removed from between garment 101 and jacket 103. Lanyard 111 can then be connected to dorsal ring 107 as shown in FIGS. 2 and 3*a*.

Figure 3B:
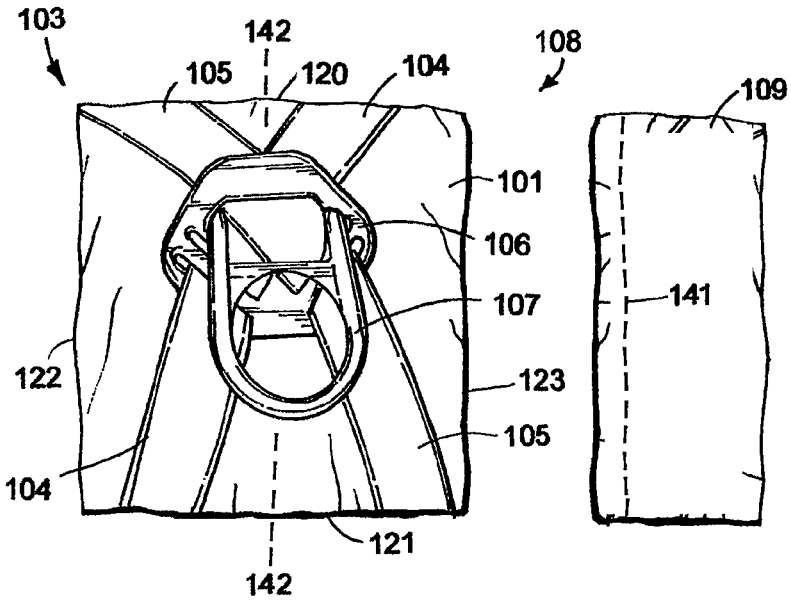
FIG. 3*b* is a close-up view of the dorsal opening of FIGS. 2 and 3*a*.
Figure 3C:
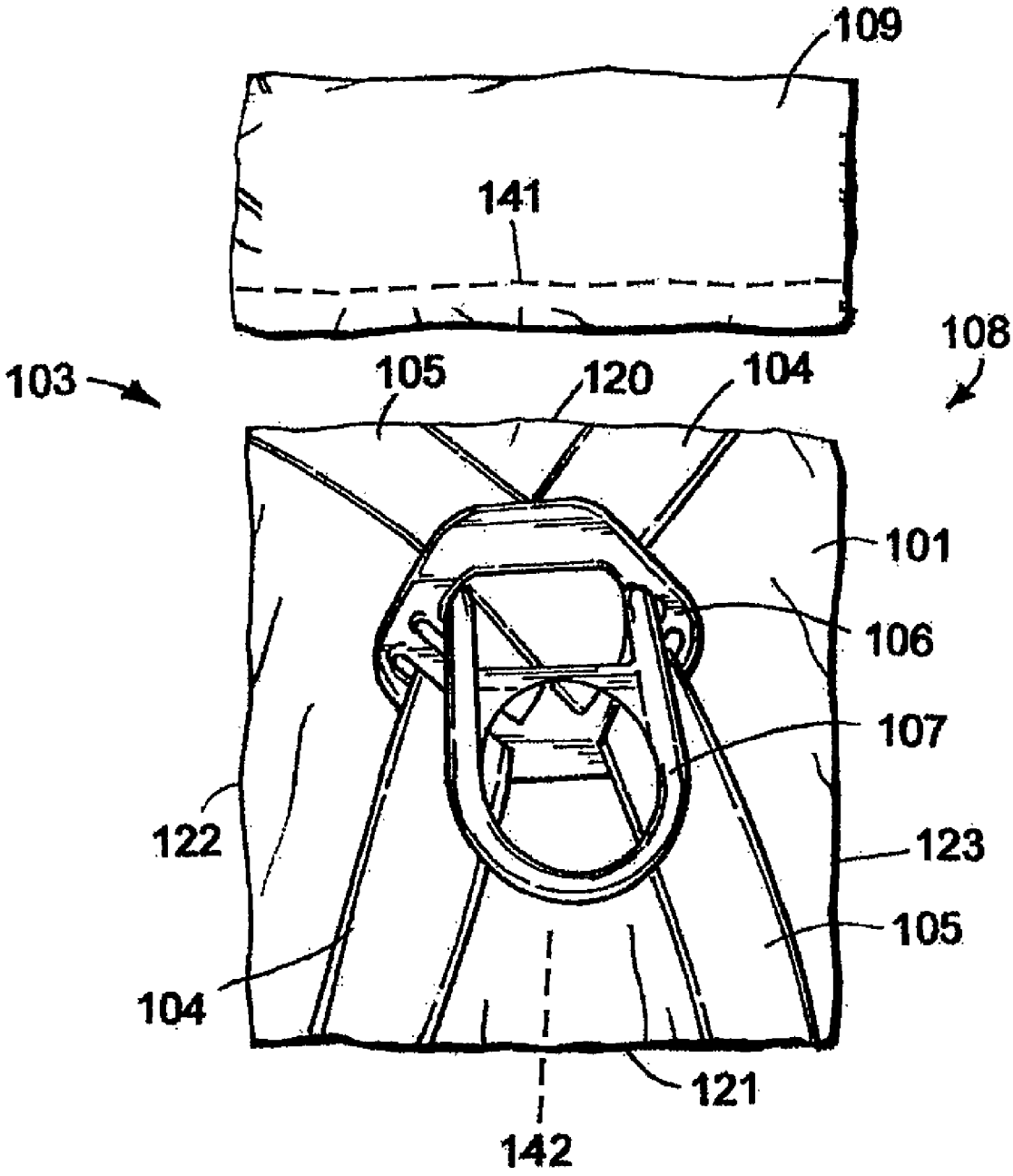
FIG. 3*c* is a close-up view of the dorsal opening of FIGS. 2 and 3*a*, with the flap positioned at a different location.

FIG. 3*b* is a close-up view of dorsal opening 108, in accordance with the invention. In this embodiment, dorsal opening 108 is rectangular in shape so it has opposed top and bottom portions 120 and 121, as well as opposed side portions 122 and 123. Flap 109 is attached to jacket 103 with stitching 141 and can be positioned at many different locations on jacket 103. Here, flap 109 is carried by jacket 103 so it is repeatably moveable between positions covering and uncovering dorsal opening 108. In accordance with the invention, flap 109 is attached to jacket 103 near side portion 123, although it could be attached to jacket 103 near another side portion. In one particular embodiment shown in FIG. 3*c*, flap 109 is attached to jacket 103 proximate to side portion 120. In this way, flap 109 is repeatably moveable between side portions 120 and 121.

In accordance with the invention, flap 109 is positioned so it is repeatably moveable between conditions covering and uncovering dorsal opening 108. When flap 109 covers dorsal opening 108 as shown in FIG. 3*b*, it extends between side portions 122 and 123 and across a reference line 142. Reference line 142 can be at many different locations relative to dorsal opening 108, but here it extends through top and bottom portions 120 and 121 and along a centerline of dorsal opening 108. In this embodiment, the centerline of dorsal opening 108 extends halfway between side portions 122 and 123 and corresponds to the centerline of jacket 103.

When flap 109 does not cover dorsal opening 108, it generally does not extend between side portions 122 and 123. Further, when flap 109 does not cover dorsal opening 108, it generally does not extend across reference line 142. In this way, flap 109 is repeatably moveable between positions covering and uncovering dorsal opening 108. FIGS. 2, 3*a* and 3*b* show dorsal opening 108 when it is uncovered by flap 109 and does not extend across reference line 142, and FIGS. 4*a*, 4*b* and 4*c* show dorsal opening 108 when it is covered by flap 109.

It should be noted that flap 109 is generally held to jacket 103 when in its covering condition. Flap 109 can be held in its covering condition in many different ways, such as by fastening it to jacket 103 proximate to side portion 122 with a fastening element. In general, a fastening element is attached to jacket 103 and a complementary fastening element is attached to flap 109. There are many different types of fastening and complementary fastening elements that can be used, such as buttons and snaps. However, in this embodiment, hook and loop tape is used, wherein loop tape 116 is carried by jacket 103 and hook tape 117 is carried by flap 109 (FIGS. 2 and 3*a*). As will be discussed in more detail presently, the fastener and complementary fastener can be used to fasten flap 109 with jacket 103 to hold dorsal ring 107 in up and down positions when it covers dorsal opening 108.

FIGS. 4*a* and 4*b* are back views of person 100, wherein dorsal ring 107 is held in up and down positions, respectively, by flap 109 when it covers dorsal opening 108. In FIG. 4*a*, dorsal ring 107 extends out of dorsal opening 108 and is held by flap 109 so it extends upwardly past top portion 120 and along the exterior of jacket 103. In FIG. 4*b*, dorsal ring 107 extends out of dorsal opening 108 and is held by flap 109 so it extends downwardly past bottom portion 121 and along the exterior of jacket 103. It should be noted that, in the up and down positions, flap 109 is fastened to jacket 103 by hook and loop tape 113 and 114 with a strong enough force to hold dorsal ring 107 in the desired position. It should also be noted that dorsal ring 107 is repeatably moveable between the up and down positions.

Safety line 110 can be attached to dorsal ring 107 with lanyard 111 when dorsal ring 107 is in the up or down position. Dorsal ring 107 is held in the up or down position to facilitate the attachment of safety line 110 to it. For example, in FIG. 4*b*, dorsal ring 107 is held by flap 109 in the down position and safety line 110 is attached to it with lanyard 111. The attachment of safety line 110 to dorsal ring 107 is facilitated because it is held in place and is less likely to undesirably move around when attaching lanyard 111 thereto.

As mentioned above, lanyard 111 and safety line 110 are repeatably moveable between being connected to dorsal ring 107 as shown in FIGS. 2 and 3*a*, and as shown in FIG. 4*c*. This is useful because, when safety line 110 is connected to dorsal ring 107 as shown in FIG. 4*c*, jacket 103 can be removed while person 100 is protected from experiencing an unsecured fall. However, person 100 is undesirably exposed to experiencing an unsecured fall when moving lanyard 111 and safety line 110 between positions shown in FIG. 4*c* and FIGS. 2 and 3*a*. Person 100 is exposed to experiencing an unsecured fall because lanyard 111 and safety line 110 are disconnected from dorsal ring 107.

Figure 5A:
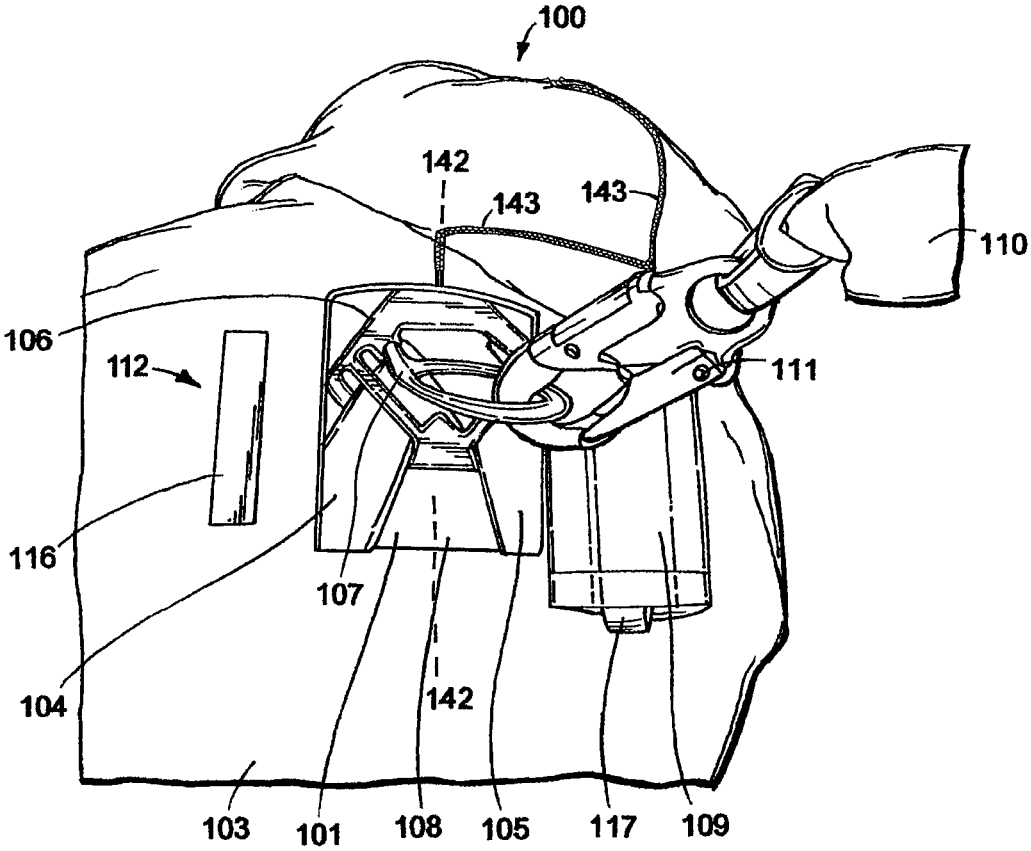
FIG. 5*a* is a close-up view of a dorsal opening with a zipper extending through the jacket and away from it.
Figure 5B:
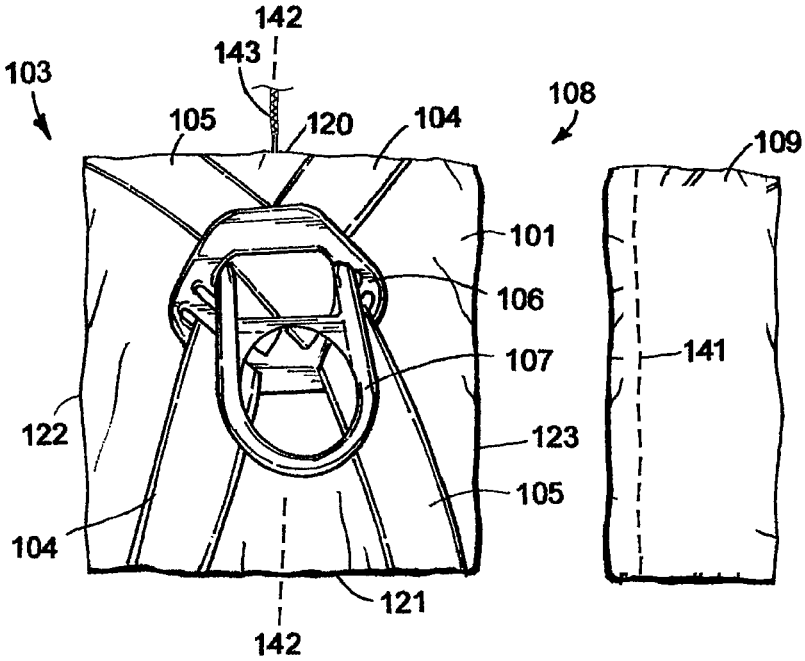
FIG. 5*b* is a close-up view of the dorsal opening of FIG. 5*a*.

FIG. 5*a* is a close-up view of back portion 112 of jacket 103, showing dorsal opening 108 with a zipper 143 extending away from it along centerline 142. FIG. 5*b* is a close-up view of dorsal opening 108 and zipper 143, as shown in FIG. 5*a*. In accordance with the invention, zipper 143 extends through jacket 103 and is positioned so that jacket 103 can be removed from person 100 without removing lanyard 111 from dorsal ring 107. In this way, person 100 can remove jacket 103 and replace it with another one without being exposed to experiencing an unsecured fall. It should be noted that zipper 143 can be replaced with other fastening elements, such as hooks, buttons and snaps.

Figure 6A:
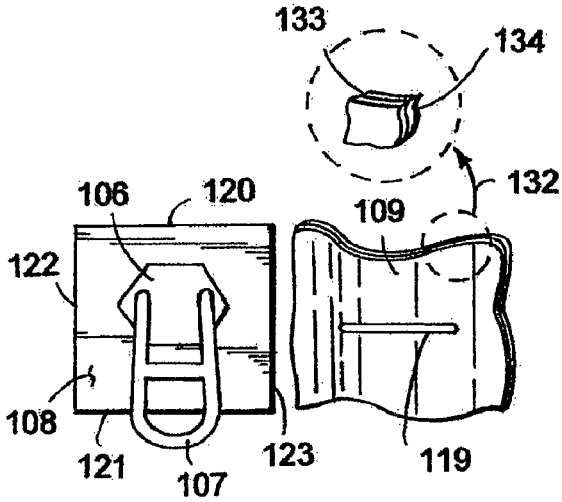
FIGS. 6*a* and 6*b* are close-up views of an embodiment of a flap having a dorsal slit, in accordance with the invention.
Figure 6B:
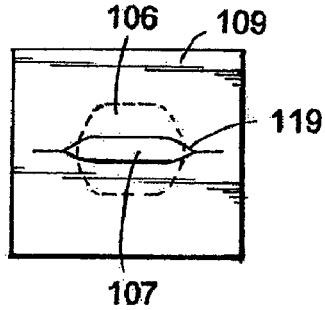

FIGS. 6*a* and 6*b* are close-up views of flap 109 with a dorsal slit 119, in accordance with the invention. In this embodiment, dorsal slit 119 is positioned so that dorsal ring 107 can extend through it when flap 109 covers dorsal opening 108, as shown in FIG. 6*b*. Dorsal ring 107 is held in an upright position in FIG. 6*b*, wherein it extends outwardly from flap 109. Dorsal ring 107 is held in the upright position because dorsal slit 119 extends perpendicular between opposed sides of flap 109. However, it should be noted that dorsal ring 107 can be held so it extends upwardly and downwardly towards top portion 120 and bottom portion 121, respectively, of opening 108. Dorsal ring 107 can be held so it extends upwardly or downwardly by having dorsal slit 119 extend through flap 109 at an angle between its opposed sides.

In accordance with the invention, flap 109 includes a resilient material so that dorsal slit 119 conforms to dorsal ring 107 when dorsal ring 106 extends through it. In this way, weather conditions are repelled from flowing through the interface between dorsal slit 119 and dorsal ring 107. The resilient material can be of many different types, such as neoprene and rubber. It should also be noted that in some embodiments, flap 109 can include more than one layer. For example, a resilient material region 134 can be carried on a supporting substrate 133, as indicated by a substitution arrow 132 shown in FIG. 6*a*. Here, resilient material region 134 is positioned so that it faces outwardly from jacket 103 when flap 109 covers dorsal opening 108.

Figure 7A:
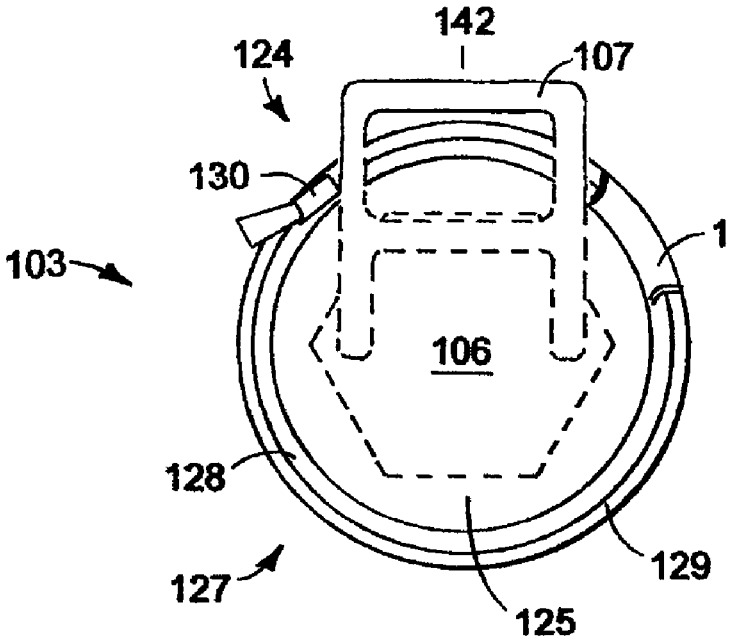
FIGS. 7*a* and 7*b* are close-up views of a round dorsal opening with a round flap covering and uncovering it, respectively, in accordance with the invention.
Figure 7B:
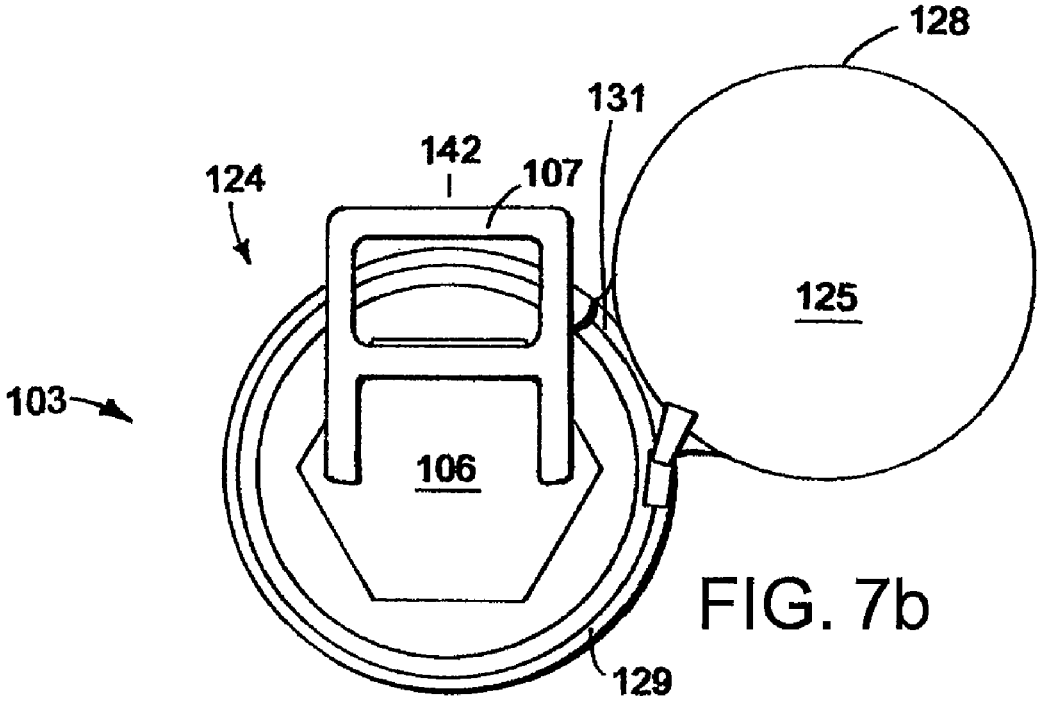

FIGS. 7*a* and 7*b* are close-up views of a round dorsal opening 124 and round flap 125, in accordance with the invention. FIGS. 7*a* and 7*b* show round dorsal opening 124 covered and uncovered by round flap 125. Round dorsal opening 124 is positioned at the same dorsal location as opening 108 discussed above. In this embodiment, round flap 125 includes a first portion, denoted as a flap attachment region 131, fixedly attached to jacket 103. Flap attachment region 131 can be attached to jacket 103 in many different ways, such as by stitching. Flap attachment region 131 is attached to jacket 103 so it is not repeatably removeable therefrom. Flap attachment region 131 is not repeatably removeable from jacket 103 because this would require breaking the stitching, which can damage round flap 125 and jacket 103.

Round flap 125 includes a second portion attached to jacket 103 in a repeatably removeable manner. The second portion of round flap 125 is attached to jacket 103 in a repeatably removeable manner so that round flap 125 is repeatably moveable between positions covering and uncovering round dorsal opening 124. The second portion of round flap 125 can be attached to jacket 103 in a repeatably removeable manner in many different ways, but in this example a zipper 127 is used. It should be noted, however, that other fastening elements, such as buttons, snaps and hook and loop tape, can be used in other examples.

In this embodiment, zipper 127 includes a toothed portion 128 positioned around the outer periphery of round flap 125 and a toothed portion 129 positioned around the outer periphery of round dorsal opening 124. A slider 130 is connected to toothed portions 128 and 129 and is moveable along them so toothed portions 128 and 129 are repeatably moveable between engaged (FIG. 7*a*) and disengaged (FIG. 7*b*) positions with each other. Round flap 125 covers more of round dorsal opening 124 as the engagement between toothed portions 128 and 129 increases. Further, round flap 125 covers less of round dorsal opening 124 as the engagement between toothed portions 128 and 129 decreases.

In accordance with the invention, dorsal ring 107 can extend outwardly through round dorsal opening 124 and along the exterior of jacket 103 when round flap 125 covers round dorsal opening 124. In one situation, slider 101 is positioned as shown in FIG. 7*a* so that dorsal ring 107 is held between zipper 127 and flap attachment region 131. In this way, dorsal ring 107 is held in its up position, as in FIG. 4*a*. Safety line 110 can be attached to dorsal ring 107, as discussed in more detail above. It should be noted that, in other embodiments, flap attachment region 131 and zipper 127 can be moved so that dorsal ring 107 is held in its down position, as shown in FIG. 4*b*. This can be done in many different ways, such as by moving the location in which flap attachment region 131 is attached to jacket 103.

Figure 8A:
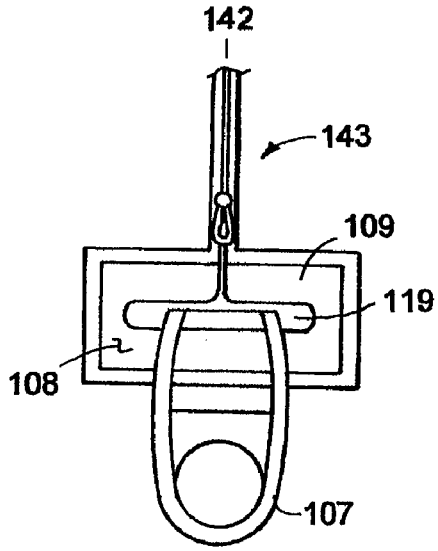
FIGS. 8*a*, 8*b* and 8*c* are close-up views of dorsal openings having rectangular, octagonal and circular shapes, respectively, with zippers extending from them and through the jacket.

FIG. 8*a* is a close-up view of another embodiment of jacket 103 having a flap with a dorsal slit, in accordance with the invention. In this embodiment, dorsal opening 108 is rectangular in shape and flap 109 covers it. Slit 119 is positioned so that dorsal ring 107 extends out of it. In accordance with the invention, zipper 143 extends through jacket 103 from top portion 120 of dorsal opening 108 and along reference line 142 away from opening 108. In this way, zipper 143 can be undone to allow person 100 to remove jacket 103 without removing safety line 110 from dorsal ring 107.

Figure 8B:
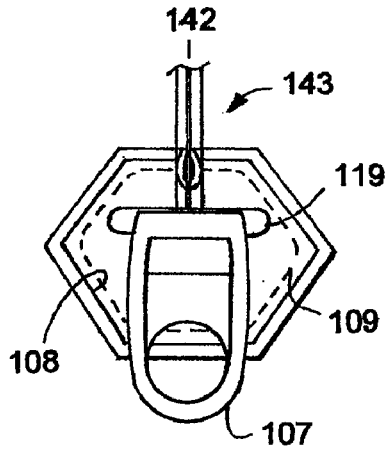
Figure 8C:
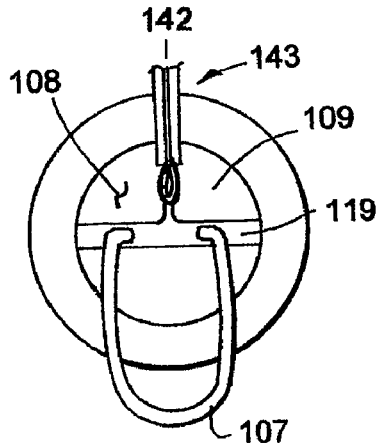

FIGS. 8*b* and 8*c* are close-up views of other embodiments of jacket 103 having flaps having dorsal slits, in accordance with the invention. In FIGS. 8*a* and 8*b*, respectively, dorsal opening 108 is a six-sided polygon and circular. In accordance with the invention, zipper 143 extends through jacket 103 and flap 109 and along reference line 142 away from opening 108.

Figure 9A:
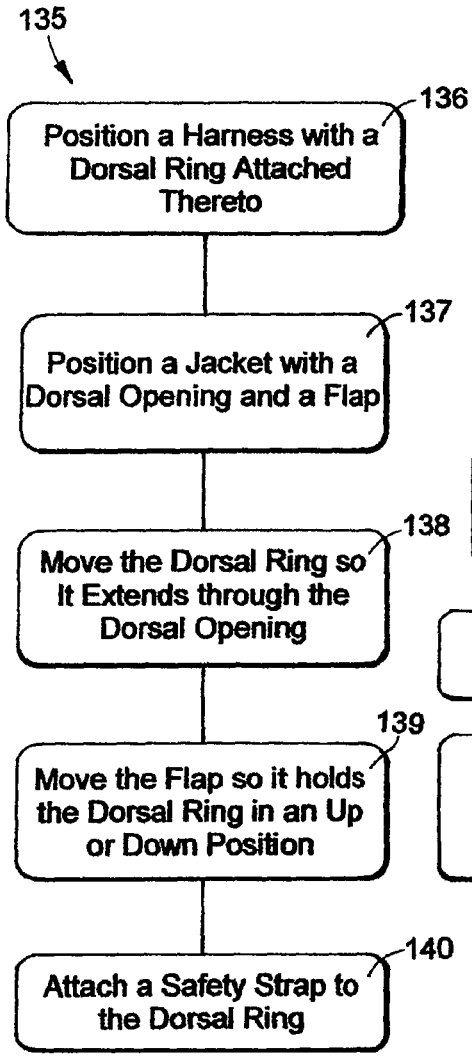
FIG. 9*a* is a flow diagram of a method of providing a safety apparatus, in accordance with the invention.

FIG. 9*a* is a flow diagram of a method 135 of providing a safety apparatus for a person, in accordance with the invention. In this embodiment, method 135 includes a step 136 of positioning a harness so the harness is worn by the person. The harness includes a dorsal ring attached thereto. Method 135 further includes a step 137 of positioning a first jacket so the first jacket is worn by the person and covers the harness. The first jacket includes a dorsal opening extending through its back portion and aligned with the dorsal ring.

A flap is attached to the jacket and is repeatably moveable between positions covering and uncovering the dorsal opening. The flap can be positioned at many different locations, but in this embodiment, it is positioned so it moves between side portions of the dorsal opening. The side portions of the dorsal opening are on opposed sides of the centerline of the dorsal opening. In this way, the flap moves from side to side across the dorsal opening and its centerline line when it covers and uncovers the dorsal opening. Method 135 also includes a step 138 of moving the dorsal ring so it extends through the dorsal opening. Method 135 includes a step 139 of moving the flap so it covers the dorsal opening and holds the dorsal ring in an up or down position. When held in the up or down position, the dorsal ring extends along the exterior of the jacket. Method 135 includes a step 140 of attaching a safety line to the dorsal ring. The dorsal ring is held in the up or down position to facilitate the attachment of the safety line to it.

Figure 9B:
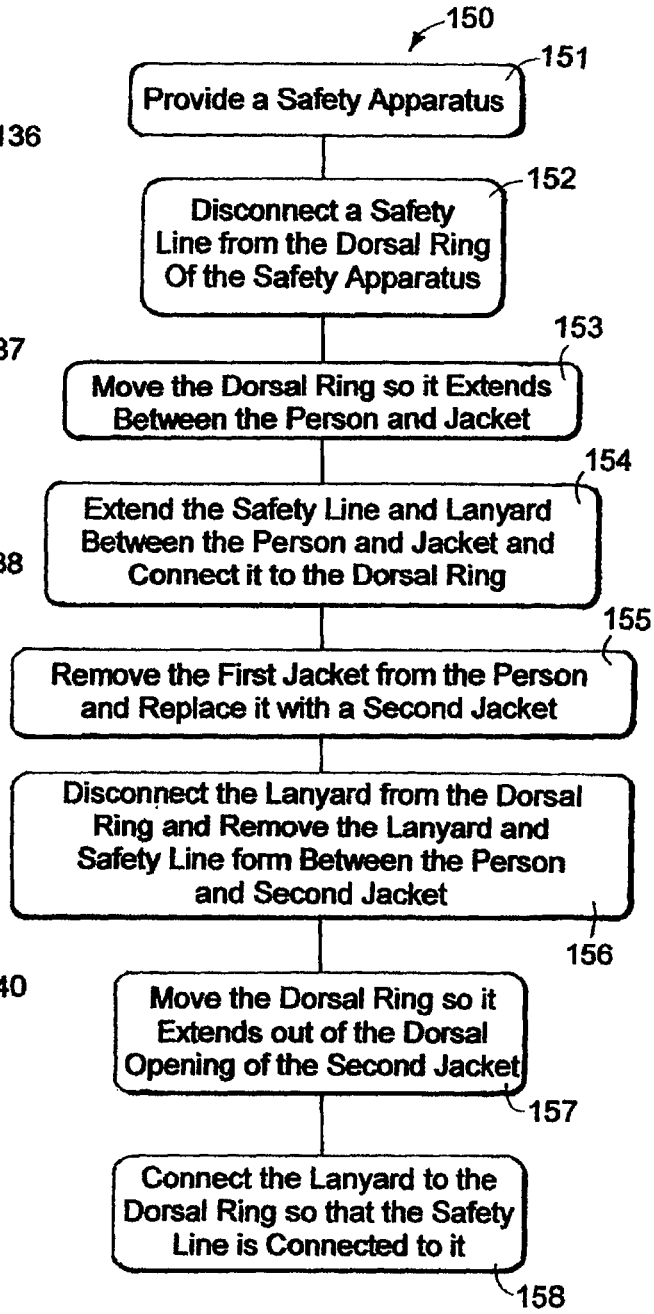
FIG. 9*b* is a flow diagram of a method of changing a jacket, in accordance with the invention.

FIG. 9*b* is a flow diagram of a method 150 of changing a jacket, in accordance with the invention. In this embodiment, method 150 includes a step 151 of providing a safety apparatus worn by a person. The safety apparatus includes a harness and first jacket worn by the person, wherein the first jacket covers the harness. The harness includes a dorsal ring attached to it and the first jacket includes a dorsal opening aligned with the dorsal ring. The safety apparatus also includes a safety line connected to the dorsal ring, wherein the dorsal ring extends through the dorsal opening. The safety line is generally connected to a lanyard and the lanyard is connected to the dorsal ring. In this way, the safety line is connected to the dorsal ring. It should be noted that, in step 151, the safety line and lanyard are positioned at the exterior of the first jacket.

In this embodiment, method 150 includes a step 152 of disconnecting the safety line from the dorsal ring. The safety line is disconnected from the dorsal ring by disconnecting the lanyard from it. Method 150 includes a step 153 of moving the dorsal ring so it extends between the person and first jacket. In this way, the safety line and lanyard are positioned at the interior of the first jacket. Method 150 includes a step 154 of extending the safety line and lanyard between the person and first jacket and connecting the lanyard to the dorsal ring. This is useful so that the person can remove the first jacket while being protected from experiencing an unsecured fall, as will be discussed in more detail presently.

Method 150 includes a step 155 of removing the first jacket from the person and replacing it with a second jacket. The second jacket is generally a different type of jacket than the first one. For example, in one embodiment, the first and second jackets are heavy and light jackets, respectively. In another embodiment, the first and second jackets are light and rain jackets, respectively. In this embodiment, the second jacket also includes a dorsal opening positioned so it is aligned with the dorsal ring when the second jacket is being worn.

In this embodiment, method 150 includes a step 156 of disconnecting the lanyard from the dorsal ring and removing the lanyard and safety line from between the person and second jacket. Method 150 includes a step 157 of moving the dorsal ring so it extends out of the dorsal opening of the second jacket. Method 150 includes a step 158 of connecting the lanyard to the dorsal ring so that the safety line is connected to it. It should be noted that, in step 158, the safety line and lanyard are positioned at the exterior of the second jacket.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A safety apparatus for a person, comprising:

a harness worn by the person, the harness including a dorsal ring;

a jacket with a dorsal opening extending therethrough, the jacket and harness being repeatably separable from each other; and a flap attached to the jacket, the flap being repeatably moveable across a centerline of the jacket and between opposed side portions of the opening;

wherein the flap includes a dorsal slit, the flap including a resilient material that conforms to the shape of the dorsal ring when it extends through the dorsal slit.

2. The apparatus of claim 1, wherein the dorsal ring is repeatably moveable between positions extending through the dorsal opening and extending between the person and jacket.

3. The apparatus of claim 1, wherein the flap is repeatably moveable between first and second positions covering and uncovering the opening, respectively.

4. The apparatus of claim 3, wherein, in the first position, the flap holds the ring upwardly or downwardly so it extends along the exterior of the jacket.

5. The apparatus of claim 1, wherein the flap is repeatably moveable between fastened and unfastened positions with the jacket.

6. The apparatus of claim 1, further including a safety line attached to the dorsal ring, the attachment between the safety line and dorsal ring being repeatably moveable between positions enclosed and unenclosed by the jacket.

7. A safety apparatus for a person, comprising:

a harness worn by the person, the harness including a dorsal ring;

a jacket repeatably moveable between positions covering and uncovering the harness, the jacket including a dorsal opening aligned with the dorsal ring; and a flap attached to the jacket, the flap being repeatably moveable between first and second positions covering and uncovering the opening, respectively, the flap being on one side of a centerline of the jacket in the second position, and the flap extending across a centerline in the first position;

wherein, in the first position, the flap holds the dorsal ring upwardly or downwardly so the dorsal ring extends along the exterior of the jacket;

wherein the flap includes a dorsal slit, the flap including a resilient material that conforms to the shape of the dorsal ring when it extends through the dorsal slit.

8. The apparatus of claim 7, further including a zipper for attaching and unattaching the flap to and from the jacket.

9. The apparatus of claim 7, wherein a first portion of the flap is directly attached to the jacket and a second portion of the flap is fastened to the jacket with a zipper.

10. The apparatus of claim 9, wherein the dorsal ring extends through the opening and between the jacket and second portion of the flap unfastened with the jacket.

11. A method of providing a safety apparatus for a person, comprising:

positioning a harness so the harness is worn by the person, the harness including a dorsal ring;

positioning a first jacket so the first jacket is worn by the person, the first jacket including a dorsal opening aligned with the dorsal ring;

moving the dorsal ring so it extends through the dorsal opening; and moving a flap so it covers the dorsal opening and holds the dorsal ring in an up or down position, wherein the step of moving the flap includes moving the flap from one side of a centerline of the jacket so the flap extends across the centerline of the jacket;

wherein the flap includes a dorsal slit, the flap including a resilient material that conforms to the shape of the dorsal ring when it extends through the dorsal slit.

12. The method of claim 11, further including replacing the first jacket with a second jacket without removing the harness from the person.

13. The method of claim 12, wherein the second jacket includes a dorsal opening, the dorsal ring extending through the dorsal opening of the second jacket.

14. The method of claim 12, further including attaching a safety line to the dorsal ring.

15. The apparatus of claim 7, wherein the flap is moved from one side of the centerline of the jacket to across the centerline of the jacket in response to moving the flap from the second position to the first position.

16. The method of claim 11, wherein the step of moving the flap includes moving it across a centerline of the jacket.

17. The apparatus of claim 3, in the first position, the flap holds the ring upwardly so it extends along the exterior of the jacket.

18. The apparatus of claim 7, in the first position, the flap holds the ring upwardly so it extends along the exterior of the jacket.

19. The method of claim 11, wherein the position is the up position and the ring extends along the exterior of the jacket.

* * * * *